US006409185B1

(12) United States Patent
Savietto

(10) Patent No.: US 6,409,185 B1
(45) Date of Patent: Jun. 25, 2002

(54) ROLLER SKATE WITH REMOVABLE BOOT

(75) Inventor: Sebastiano Savietto, Gaetano Montebelluna (IT)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 09/409,133

(22) Filed: Sep. 30, 1999

(30) Foreign Application Priority Data

Oct. 1, 1998 (FR) ..... 98 12514

(51) Int. Cl.[7] ..... A63C 1/00
(52) U.S. Cl. ..... 280/11.27; 280/11.33
(58) Field of Search ..... 280/11.27, 11.33, 280/11.3, 613

(56) References Cited

U.S. PATENT DOCUMENTS

| | | | | |
|---|---|---|---|---|
| 5,193,827 A | | 3/1993 | Olson | |
| 5,671,941 A | * | 9/1997 | Girard | 280/613 |
| 5,697,631 A | | 12/1997 | Ratzek et al. | |
| 5,853,188 A | * | 12/1998 | Alden | 280/613 |
| 6,105,993 A | * | 8/2000 | Gignoux | 280/613 |
| 6,120,038 A | * | 9/2000 | Dong et al. | 280/613 |
| 6,145,868 A | * | 11/2000 | Schaller et al. | 280/613 |

FOREIGN PATENT DOCUMENTS

| | | | | |
|---|---|---|---|---|
| DE | 961064 | * | 1/1975 | 280/613 |
| DE | 196 02 667C | A | 10/1997 | |
| EP | 0 844 009 | A | 5/1998 | |
| EP | 0 878 219 | A1 | 11/1998 | |
| FR | 2 763 003 | | 7/1999 | |

OTHER PUBLICATIONS

French Preliminary Search Report in SN 9812514—France.

* cited by examiner

*Primary Examiner*—Douglas Hess
*Assistant Examiner*—Ed Gort
(74) *Attorney, Agent, or Firm*—Bugnion S.A.; John Moetteli

(57) ABSTRACT

Roller skate, the chassis (1) of which is equipped with a latch (35) equipped with nibs (36,37) which automatically lock the bars (26,27) of a boot in notches (33,34) of the chassis under the tension of a spring (44). The latch can be held in the open position by a catch (47) which can be actuated by one of the bars (26). The chassis is also equipped with a retractable abutment (30) which opposes the movement of the latch in the absence of any boot, this abutment being parted from the latch by one of the bars (27) of the boot when the boot is being put on. This retractable abutment on the one hand ensures that the two bars of the boot are suitably engaged in the notches in the chassis and, on the other hand, prevents inadvertent and dangerous closure of the latch when manipulating the skate.

6 Claims, 2 Drawing Sheets

ROLLER SKATE WITH REMOVABLE BOOT

BACKGROUND OF THE INVENTION

The invention relates to a roller skate comprising a chassis equipped with rollers and a boot attached removably to the chassis and the sole of which is equipped with a pair of bars or with two pairs of tenons for attaching the boot to the chassis at two points located respectively in the heel region and in the front region of the foot, so that one of these bars, or tenons, can automatically be caught by a catching element which is common to the two bars, or tenons, mounted to slide longitudinally on or in the chassis and subjected to the action of a spring which tends to keep it in the caught-on position, this catching element being arranged and mounted in such a way that it automatically catches on the bars, or tenons, when the bars, or tenons, are pressed down onto the chassis.

Two embodiments of such a roller skate are described in Patent Application EP 0 878 219, the content of which is incorporated by reference. According to a first embodiment, the chassis has two parallel vertical walls in which there are formed V-shaped notches intended to house the bars of the boot. Mounted in the chassis is a longitudinal catching member equipped with two pairs of nibs which lock the bars into the bottom of the V-shaped notches. When the skate is being put on the foot, these nibs are parted by the bars against the action of the spring of the catching element. The bars do not generally engage simultaneously in the V-shaped notches of the chassis; one of the bars may become caught on the chassis while the other bar is not yet caught, or may even remain uncaught.

According to another embodiment, the common catching element is kept in an uncaught open position by a catch which passes through one of the pairs of V-shaped notches of the chassis, this catch being actuated by the engagement of the corresponding bar in these notches so as to release the catching member. If the bar which actuates the catch is engaged in these notches while the other bar is still out of the corresponding notches, what may happen is that this other bar may no longer be able to become caught as the released catching element will close off the corresponding notches. Furthermore, what may happen is that the catch may be actuated inadvertently when manipulating the skate without its boot, and this may cause injury to fingers which may unfortunately have been engaged in one of the notches of the chassis.

SUMMARY OF THE INVENTION

The object of the invention is to alleviate the above-mentioned drawbacks.

To this end, the boot according to the invention is one whose chassis is equipped, at least at one boot-attachment point, with an elastically retractable abutment which opposes the movement of the catching element, in the absence of any boot, this abutment being held away from the catching element by one of the bars, or one of the tenons, when the boot is being put on, so as to allow the catching element to catch on the bars, or the tenons.

When the skate is equipped with a catch, only one retractable abutment is needed, at the attachment point where the bar does not encounter the catch. As long as this abutment is not parted from the catching element, actuating the catch will not allow the catching member to advance. This member will not be able to advance into its catching and locking position until both bars are engaged in the chassis. Furthermore, inadvertent actuation of the catch when manipulating the chassis will not, by itself, allow the catch to advance, and this will prevent the user from running the risk of trapping a finger.

When the skate is not equipped with a catch and when the catching member is in the closed position at rest, the chassis is equipped with two retractable abutments, one abutment at each point of attachment of the boot to the chassis, so that the catching element cannot be pushed to then catch on the bars under the action of its spring except when both bars are engaged in the chassis. It is thus possible to be certain that the skate is attached to the chassis at both attachment points.

The retractable abutments may be of the rocking or pivoting type or the type which can move in a translational movement, that is to say which can retract by pushing by the bars or the tenons of the boot.

BRIEF DESCRIPTION OF THE DRAWING(S)

The appended drawing depicts, by way of example, two embodiments of the invention.

DETAILED DESCRIPTION OF THE PREFERRED EMBODIMENTS

Figure 1:
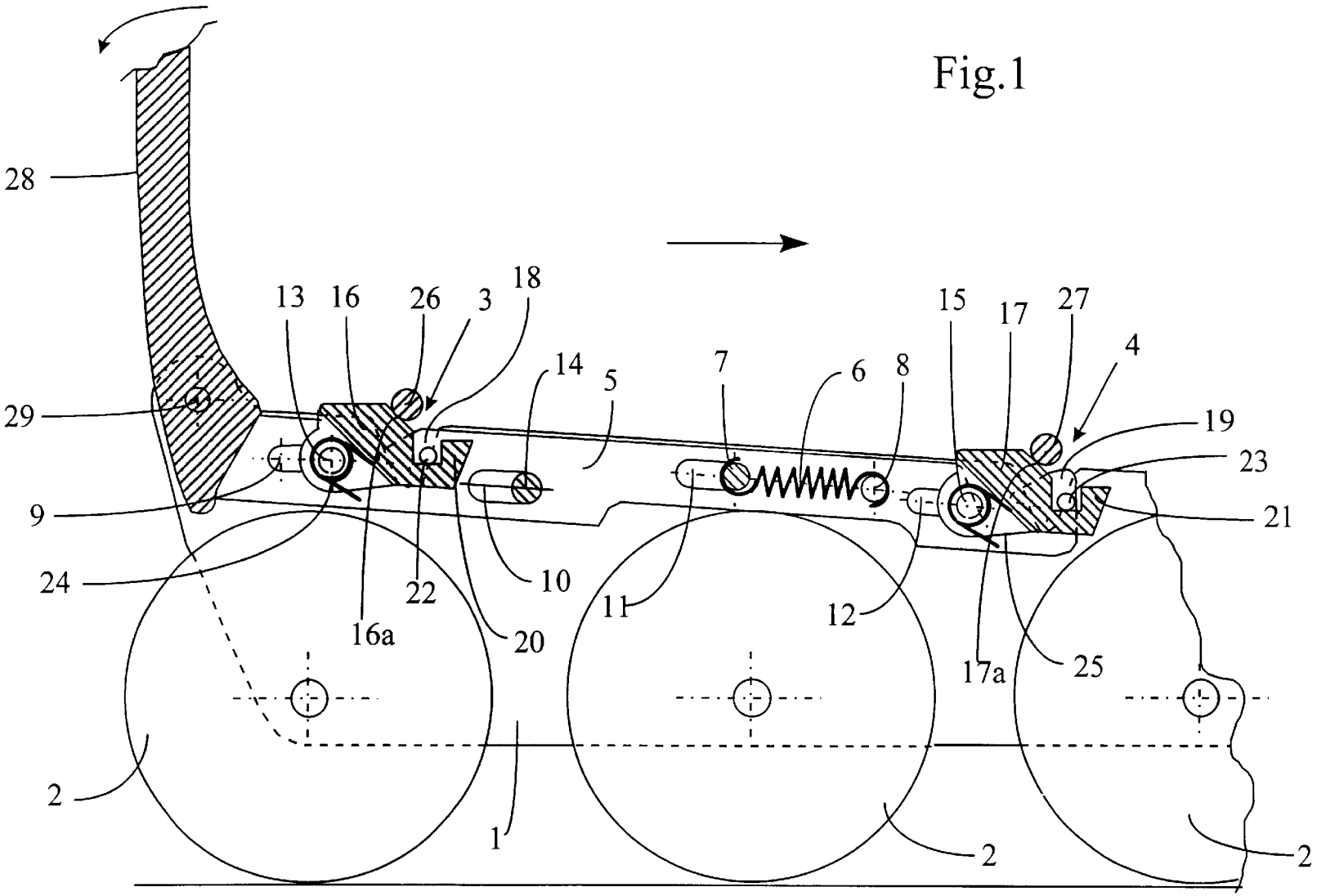
FIG. 1 is a part view in vertical axial section of a skate with automatic catching and no catch.

The skate depicted in FIG. 1 is identical to the skate depicted and described in French patent No 97 05 862 and EP 0 878 219, the contents of which are incorporated herein by reference, except for the retractable abutments. This skate essentially comprises a chassis 1 which has two spaced-apart parallel vertical walls between which four in-line rollers 2 are mounted, three of which rollers are visible in the drawing. The chassis 1 has two pairs of V-shaped notches 3 and 4 arranged transversely opposite each other in each pair. Mounted between the walls of the chassis is a catching and locking element consisting of a latch 5 formed of two parallel cut-out pieces, it being possible for this latch 5 to move longitudinally in the chassis 1 against the action of a spring 6 working in tension between a transverse bar 7 fixed to the chassis and a bar 8 fixed to the latch 5. The latch 5 has four pairs of longitudinal slots 9,10,11,12 through which respective bars 13,14, the bar 7 and a fourth bar 15 attached to the chassis 1 pass, the slots 9 to 12 allowing the longitudinal movement of the latch 5 and guiding it. As described in French patent No 97 05 862, the latch 5 is equipped with two pairs of nibs 18 and 19 located, at rest, facing the V-shaped notches 3 and 4. The outside of these nibs 18 and 19 consists of a ramp which allows these nibs to be parted by vertical pressure on these ramps. The bars 13 and 15 act primarily as articulation axes for two retractable abutments 16 and 17 on the chassis. Given the guidance provided by the bars 13 and 15, the guidance by the bar 14 could be omitted.

The retractable abutments 16 and 17 are mounted between the two parts of the latch 5. These abutments 16 and 17 have a hook-shaped part 20,21, respectively, extending toward the front of the skate and engaging, from beneath, behind a bar 22,23 respectively, secured to the latch 5 in such a way as to prevent the latch from moving forward, in the direction shown by an arrow. The abutments 16 and 17 are kept pressed against the bars 22 and 23 by a spring 24,25 respectively, in the shape of a hunting horn and wound around the bar 13,15 respectively. On their upper side, the retractable abutments 16 and 17 have a ramp 16*a* and 17*a* respectively, which is located in the region of the V-shaped notches 3 and 4 and ends approximately on the vertical axis of symmetry of these notches.

The only part of the boot depicted is the bars 26 and 27 which extend transversely to the sole.

When the skate is being put on the foot, if the bars 26 and 27 are brought correctly to face the notches 3 and 4, they will push back the retractable abutments 16 and 17 so as to release the latch 5, itself pushed back by the bars 26 and 27 which press against the front flank of the V-shaped notches 3 and 4 and can therefore engage to the bottom of these notches. The latch 5 then retreats under the effect of its spring 6 and locks the bars 26 and 27 in the bottom of the notches 3 and 4.

The latch 5 is released only if the two retractable abutments 16 and 17 have pivoted, that is to say only if both bars 26 and 27 of the boot are engaged in the V-shaped notches 3 and 4.

To remove the boot, the skate has an unlocking lever 28 articulated to the chassis 1 about an axis 29 and actuation of which, in the direction of the arrow, pushes the latch 5 forward so as to release the bars 26 and 27. When the latch 5 is thus pushed forward and the bars 26 and 27 are extracted from the V-shaped notches 3 and 4, the ends of the hooks 20 and 21 of the retractable abutments press against the bars 22 and 23 and then, when the lever 28 is released, the abutments 16 and 17 revert to the position depicted in the drawing under the effect of their springs 24 and 25.

Figure 2:
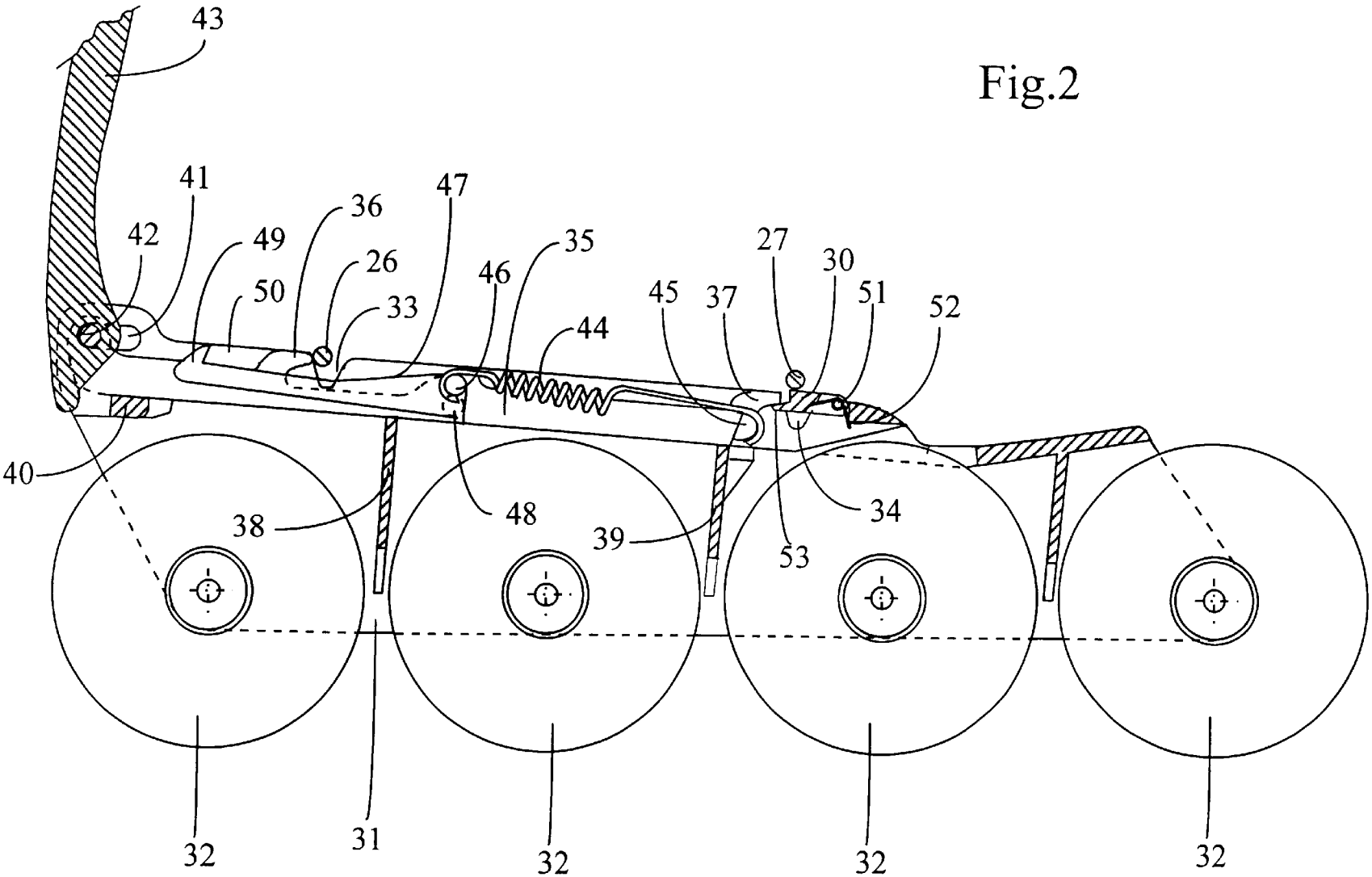
FIG. 2 is a view in axial section of a skate equipped with a catching element that has a catch.

The skate depicted in FIG. 2 is a skate with a catch similar to the skate with a catch described in Patent Application EP 0 878 219, the content of which is incorporated by reference, except for the retractable abutment 30. Like the skate according to the first embodiment, this skate comprises a chassis 31 with two spaced-apart parallel wings, between which wings four in-line rollers 32 are mounted. The chassis 31 also has two pairs of V-shaped notches 33 and 34 intended to house the two bars 26 and 27 of the boot. The catching element consists of a latch 35 consisting of two parallel plates secured together and each equipped with two nibs 36 and 37 which are intended to hold the bars 26 and 27 in the notches 33 and 34. The latch 35 can move longitudinally in the chassis, guided by the chassis spacer pieces 38 and 39 and, at the rear, by a spacer piece 40 and by a pair of slots 41 in the chassis, through which there passes an axle 42 secured to the latch 35 and passing through an unlocking lever 43.

The latch 35 is subject to the action of a tension spring 44 hooked, by one of its ends, to a fixed point 45 of the chassis and, by its other end, to a bar 46 secured to a catch 47, itself articulated to the latch 35 about an axle 48 located just below the bar 46, so that the torque exerted by the spring on the catch 47 is low in comparison with the tension force of the spring 44. The catch 47 has a nib 49 which catches on a stop 50 of the chassis.

The retractable abutment 30 is articulated to the chassis about a transverse axle 51 and is kept in a horizontal position by a spring 52 in the shape of a hunting horn. The retractable abutment 51 also has a nib 53 by means of which the retractable abutment is held by the nib 37 of the latch.

When the skate is being put on the foot, if the user first of all engages the front bar 27 in the skate, this bar will push back the retractable abutment 30 and engage in the notches 34. The latch remains immobile. When the bar 26 is then engaged in the notches 33, it pushes back the catch 47, and this has the effect of releasing the latch 35 which advances under the effect of the spring 44 and locks the bars 26 and 27 in the notches.

If, on the other hand, the user first of all engages the bar 26 in the notches 33 and thus actuates the catch 47, the latch 35, released, immediately comes into abutment against the retractable abutment 30 and does not lock the bar 26 as long as the bar 27 is not engaged in the notches 34. The rear bar 26 cannot thus be attached without at the same time attaching the front bar 27.

By contrast if, when manipulating the chassis, the user inserts a finger in the notches 33 and actuates the catch 47, the latch 35 will also be held by the retractable abutment 30 so that the user's finger will not be trapped in the notches 33, as this could cause a very painful injury.

The positions of the catch and of the retractable abutment could of course be reversed.

In the two embodiments described, the retractable abutments could consist of abutments which can move with a translational movement, downward, against the action of a spring working in compression.

According to an alternative form which has not been depicted, but which is easy to understand without a drawing, the end of the retractable abutment, more specifically its front face, against which the latch rests in the event of inadvertent release, has a groove or one or two recesses in which the nibs 37 of the latch can engage so as to immobilize the retractable abutment on the latch. This precaution further improves safety, because it becomes impossible to push the retractable abutment back without first of all rearming the latch using the lever 43.

Although illustrative embodiments of the invention have been shown and described, a wide range of modification, change, and substitution is contemplated in the foregoing disclosure and in some instances, some features of the present invention may be employed without a corresponding use of the other features Accordingly, it is appropriate that the appended claims be construed broadly and in a manner consistent with the scope of the invention.

What is claimed is:

1. A roller skate comprising a chassis equipped with rollers and a boot removably attached to the chassis, the sole of which has a pair of bars or two pairs of tenons for attaching the boot to the chassis at two points located respectively in the heel region and in the front region of the foot, so that these bars, or tenons, catch in a catching element which is common to the two bars or tenons, the catching element being mounted to slide longitudinally on or in the chassis and biased by a spring which tends to keep the catching element in the captured position, the catching element automatically catching on the bars or tenons when the bars or tenons are pressed down onto the chassis, wherein the chassis is equipped, at least at one boot-attachment point, with an elastically retractable abutment, this abutment being displaced away from engagement with the catching element by a bar or tenon of the boot when the boot is being put on, so as to allow the catching element to catch on the bars or the tenons.

2. The roller skate as claimed in claim 1, in which the chassis has notches intended to house the bars or tenons and in which the catching element, in the catching position at rest, is equipped with catching nibs which cooperate with said notches to hold the bars or tenons in the notches, said nibs having a ramp against which the bars or tenons react to displace the nibs so as to allow the bars or tenons to pass when the boot is being put on, wherein the abutments individually block movement of the catching element and have a part which is shaped in such as way as to catch on the catching element to prevent it from moving under the action of just one of the bars or pairs of tenons.

3. The roller skate as claimed in claim 1, in which the catching element is equipped with a catch located in the region of one of the points for attaching the boot to the chassis, this catch allowing the catching element to be held in the open position against the action of its spring and being actuated by one of the bars or pairs of tenons when the boot is being put on so as to release the catching element, wherein the chassis is equipped with just one retractable abutment at the other point of attachment of the boot to the skate where there is no catch, this abutment being mounted in such a way as to block the advance of the catching element released by activation of the catch.

4. The roller skate as claimed in claim 3, wherein the end of the retractable abutment has a groove or recess in which the catching element engages when the catch released, so as to immobilize the catching element.

5. The roller skate as claimed in claim 3, in which the chassis has two parallel vertical walls with notches at the attachment points, which notches are intended to house the bars or tenons, and in which the catching element is mounted between said walls, wherein the retractable abutment is articulated between said walls.

6. The roller skate as claimed in claim 1, wherein the retractable abutments can be retracted in a translational movement parallel to the longitudinal direction of the chassis.

* * * * *